US007937874B2

(12) United States Patent
Roth

(10) Patent No.: US 7,937,874 B2
(45) Date of Patent: May 10, 2011

(54) FIREARM GRIPS AND FIREARM GRIP CONSTRUCTION SETS

(75) Inventor: Marc Roth, Oberndorf (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 534 days.

(21) Appl. No.: 11/868,268

(22) Filed: Oct. 5, 2007

(65) Prior Publication Data

US 2010/0212202 A1 Aug. 26, 2010

Related U.S. Application Data

(63) Continuation of application No. PCT/EP2006/003090, filed on Apr. 5, 2006.

(30) Foreign Application Priority Data

Apr. 7, 2005 (DE) ..... 10 2005 016 020

(51) Int. Cl.
*F41C 23/00* (2006.01)

(52) U.S. Cl. ..... 42/72; 42/7; 42/71.02; 89/1.42

(58) Field of Classification Search ..... 42/7, 72, 42/71.02, 75.03; 89/1.42
See application file for complete search history.

(56) References Cited

U.S. PATENT DOCUMENTS 1,410,266 A * 3/1922 Pedersen ..... 42/7

(Continued)

FOREIGN PATENT DOCUMENTS

EP 0729004 8/1996

OTHER PUBLICATIONS

International Bureau, "Notification of Transmittal of Translation of the International Preliminary Report on Patentability (Chapter I or II of the Patent Cooperation Treaty", for counterpart PCT application Serial No. PCT/EP2006/003090, mailed Mar. 6, 2008 (7 pages).

(Continued)

*Primary Examiner* — J. W Eldred
*Assistant Examiner* — Gabriel J Klein
(74) *Attorney, Agent, or Firm* — Hanley, Flight and Zimmerman, LLC

(57) ABSTRACT

A firearm grip, a firearm grip construction set and related methods are disclosed. An example firearm grip includes a grip portion, which includes a wall covering at least a portion of a magazine and a plurality of ribs. The firearm grip also has a first grip shell having a plurality of first lateral edges, second grip shell having a plurality of second lateral edges, and a grip back having a top edge and a bottom edge. With the example firearm grip, at least one of the first grip shell or the second grip shell is exchangeable. In addition, at least one of the first grip shell, the second grip shell or the grip back is coupled to the grip portion with an undercut tongue and groove connection. Further, at least one of the first lateral edges, the second lateral edges, the top edge or the bottom edge slidably engages under one of the plurality of ribs and an opposite edge of at least one of the first lateral edges, the second lateral edges, the top edge or the bottom edge is coupled to the grip portion via an attachment. In addition, the grip back of the example firearm grip slidably engages at least one of the first lateral edges or the second lateral edges and holds at least one of the first grip shell or the second grip shell in place.

11 Claims, 9 Drawing Sheets

U.S. PATENT DOCUMENTS

| | | | | |
|---|---|---|---|---|
| 4,221,066 | A * | 9/1980 | Hillberg | 42/71.02 |
| 4,586,282 | A | 5/1986 | Sniezak | |
| 4,936,036 | A * | 6/1990 | Sniezak et al. | 42/71.02 |
| 5,231,237 | A | 7/1993 | Cupp | |
| 5,621,997 | A * | 4/1997 | Pearce | 42/71.02 |
| 5,797,207 | A | 8/1998 | Marable et al. | |
| 6,073,381 | A * | 6/2000 | Farrar et al. | 42/71.02 |
| 6,112,446 | A | 9/2000 | Forster et al. | |
| 6,802,148 | B1 | 10/2004 | Danas | |
| 7,506,469 | B2 * | 3/2009 | Poulin et al. | 42/71.02 |
| 7,587,852 | B1 * | 9/2009 | Harms | 42/71.02 |
| 2006/0096147 | A1 * | 5/2006 | Gussalli Beretta | 42/71.02 |
| 2006/0162222 | A1 * | 7/2006 | Beretta | 42/72 |

OTHER PUBLICATIONS

International Searching Authority, "International Search Report", for counterpart PCT application Serial No. PCT/EP2006/003090, mailed Jun. 30, 2006 (6 pages).

International Searching Authority, "International Preliminary Report on Patentability", for counterpart PCT application Serial No. PCT/EP2006/003090, completed Jul. 12, 2007 (17 pages).

* cited by examiner

FIREARM GRIPS AND FIREARM GRIP CONSTRUCTION SETS

RELATED APPLICATION

This patent is a continuation of International Patent Application Serial No. PCT/EP2006/003090, filed Apr. 5, 2006, which claims priority to German Patent Application 10 2005 016 020.4, filed on Apr. 7, 2005, both of which are hereby incorporated herein by reference in their entireties.

FIELD OF THE DISCLOSURE

This disclosure relates generally to firearms, and, more particularly, to firearm grips and replacement kits for firearms equipped with the same.

BACKGROUND

Traditional firearm grips such as, for example, those known near the end of the 19$^{th}$ century, included two lateral grip shells and a grip back. The grip shells and the grip back were manufactured from hardwood, which required precise workmanship to guarantee a good grip. The wood grip shells of the Austrian handgun model 1912 (Steyr) were attached to a grip piece of a firearm by sliding the grip shells on bars from the bottom of the grip piece and were held in place by a single transverse pin. Shortly after the introduction of the 1912 (Steyr) handgun, World War I broke out and seasoned walnut wood, which is required for production of the wood grip shells, was no longer available. Alternative wood was used that, after the wood naturally dried out after a period of time, shrank, which caused the grip shells to wiggle. If, during this time period, a suitable plastic material would have been available, this problem may not have occurred. Moreover, it would have been possible to manufacture grip shells with the required precision because die-casting allows for high production numbers and, at the same time, guarantees constant high stability.

The supply industry has developed a large selection of grip shells and grip backs for firearms such as, for example, self-loading handguns, which may be manufactured from many possible types of materials. These grip shells and grip backs may be purchased along with handguns equipped with standardized grip shells as, for example, the weapon described in U.S. Pat. No. 4,586,282 ("Sniezak"). However, all of these grip shells and grip backs are designed for traditional ordinance weapons and the original grip shells are easily removed from the firearms.

Steel may be used to manufacture grip pieces, however, since the 1980's, modern self-loading handguns typically have grip pieces manufactured from a plastic material and are formed as one piece grip pieces (i.e., the grip shells form one piece with the grip pieces). Some advantages of these grip pieces are: weight reduction, corrosion protection and radical decrease of production costs because the grip pieces may be formed with high precision in one work process using composite casting and without requiring post-processing.

However, because plastic is much less firm and has lower stability than steel, the plastic composite grip pieces are much bulkier than steel grips. To make the grip pieces less bulky, the plastic grip shells and the plastic grip piece are separate pieces and the plastic grip shells assume a basic support function for the weapon. Consequently, in an emergency, a firearm with a plastic grip piece that lacks the grip shells may not be fired without being damaged, whereas, this was possible with traditional self-loading handguns with steel grip pieces.

Conventional plastic grip pieces of ordinance weapons are typically designed as one size fits all so that people over a large range of hand sizes are able to handle the weapon correctly. However, a person with a smaller hand may not be able to operate such weapons. Because there has been a decrease in the number of applicants who apply to join police forces, police forces do not exclude applicants from service based solely on their size and, thus, their compatibility with the size and dimensions of standard weapons. In addition, armed police forces include women, whose hands are usually smaller than those of men. Therefore, recent efforts have been made to equip such ordinance weapons with replaceable grip backs, so that people with different sizes of hands are able to reach the trigger of the handgun comfortably and securely. One such effort is described in U.S. Pat. No. 5,231,237 ("Cupp"). Furthermore, European Patent 0 729 004 B1 ("Wespetal") describes a handgun that includes replaceable grip pieces having a variety of surface conditions.

Such replaceable grip backs proved valuable. However, a person with a small hand who uses a handgun with a slim grip back will bend his/her finger at a different angle when activating the trigger than a person with a large hand who uses the same handgun with a larger, more bulky grip back. Only one angle of the finger is ideal when handling or firing a weapon.

DETAILED DESCRIPTION

Throughout this description, position designations such as "above," "below," "top," "forward," "rear," "left," "right," etc. are referenced to a firearm held in a normal firing position (i.e., wherein the "shooting direction" is pointed away from the marksman in a generally horizontal direction) and from the point of view of the marksman. Furthermore, the normal firing position of the weapon is always assumed, i.e., the position in which the barrel runs along a horizontal axis.

Also throughout this description, the term "grip," "grip portion," or "grip piece" refers to the part of a firearm that is normally held by a marksman when the firearm is being operated. Further, "grip" may also refer to a "grip portion" including grip shells, grip backs, etc., as discussed in greater detail below.

Figure 1:
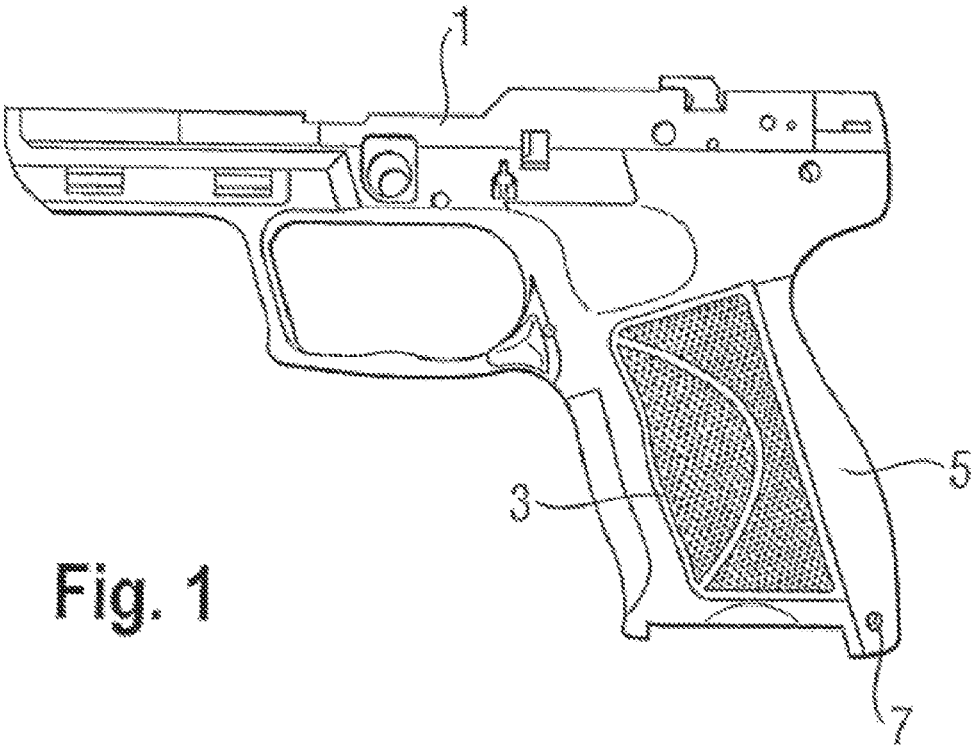
FIG. 1 illustrates an example grip portion of an example firearm including example grip shells and an example grip back.

FIG. 1 illustrates an example grip portion 1 of an example firearm, which may be, for example, a self-loading handgun. The example firearm includes grip shells 3 and a grip back 5. The grip portion 1 may be made mainly of plastic material and the grip shells 3 and the grip back 5 may be made of the same or a different material (e.g., plastic, rubber, etc.). The grip shells 3 and/or the grip back 5 may be of varying thickness. In the illustrated example, the grip back 5 and consequently the grip shells 3 are held in place by an attachment or pin 7 that is retained by a spring (not shown).

Figure 2:
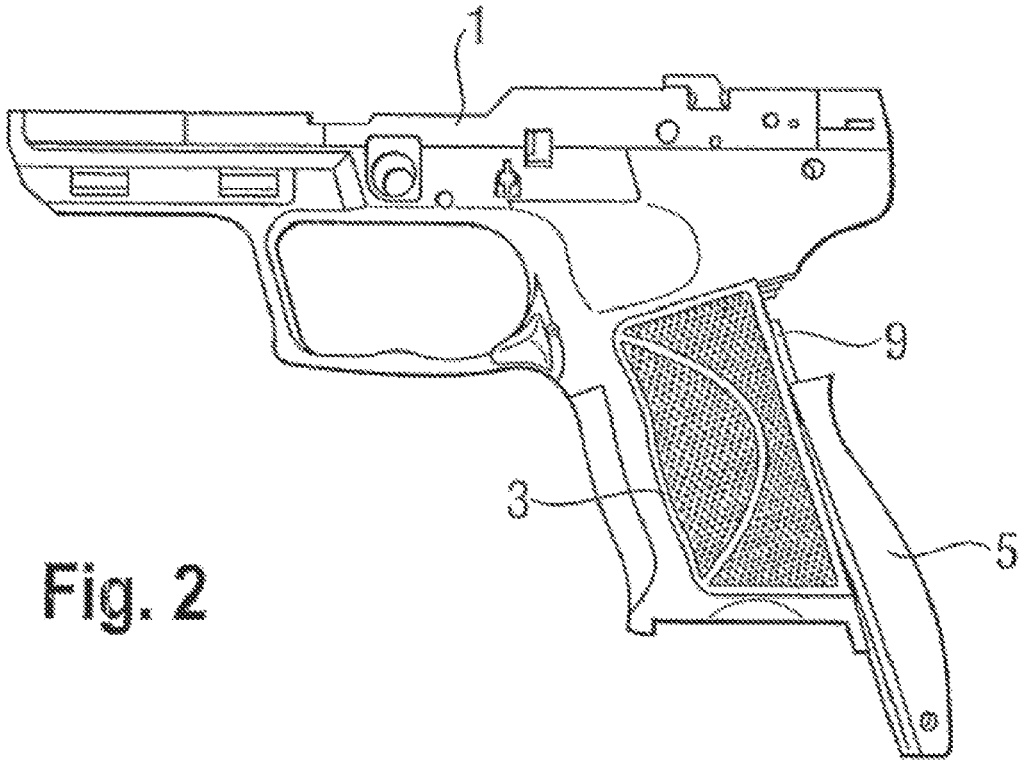
FIG. 2 illustrates the example grip portion of FIG. 1 with the example grip back partially detached.

FIG. 2 illustrates the example grip portion 1 shown in FIG. 1 with a partially detached grip back 5. The pin 7 has been removed and the grip back 5 has been slid downwardly, showing a bar assembly 9 on which the grip back 5 slides. The example illustrates that the grip back 5 covers the rear of the grip shells 3 and holds the grip shells 3 in place.

Figure 3:
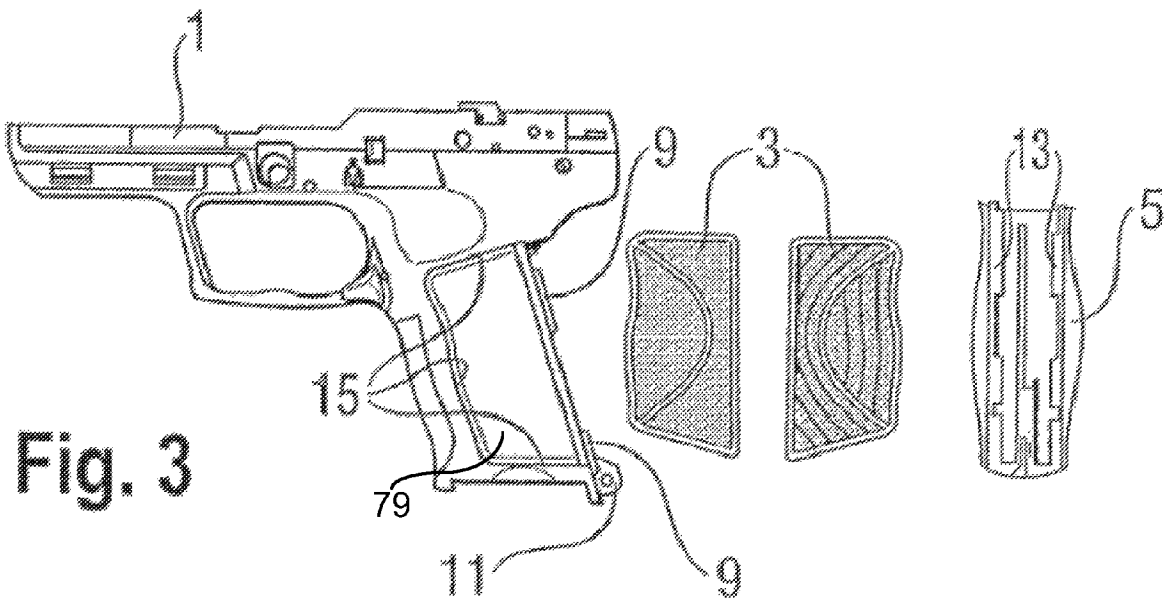
FIG. 3 is a disassembled view of the example grip portion of FIG. 1.

FIG. 3 illustrates an example "bare" grip portion 1 (i.e., a grip portion 1 without the grip shells 3 or the grip back 5 attached). Next to the grip portion 1 are two grip shells 3 and the grip back 5, all of which are attachable thereto. The example grip portion 1 may have three ribs 15 that define three sides of a conical contour that may be tapered toward the front corresponding to the contour of one or more of the grip shells 3. The ribs 15 may allow for the grip shells 3 to be attached to the grip portion 1 from the back of the grip portion 1 such that the grip shells 3 are coupled under each rib 15. Though three ribs 15 are shown in the illustrated example, any number of ribs (e.g., 1, 2, 3, 4, etc.) may be included instead.

On the rear side of the example grip portion 1, the bar assembly 9 may be seen. The bar assembly 9 includes two parallel, straight, upwardly slanted bars 9, which may be interrupted in the middle. The grip back 5 may have complementary bars 13 that may be slid onto the bar assembly 9 of the grip portion 1 so that the grip back 5 runs along the rear edges of the grip shells 3. FIG. 3 also shows an aperture 11 for a pin 7 on the grip portion 1.

The grip back 5 and each grip shell 3 are replaceable and, thus, various kinds of grips may be formed. To replace the grip shells 3 and/or the grip back 5, the pin 7 is removed, the current grip back 5 is slid off the grip shells 3 and grip portion 1, and the current grip shells 3 are slid out from under the ribs 15. The desired and/or replacement grip shells 3 are slid from the back of the grip portion 1 under the ribs 15. The desired and/or replacement grip back 5 is slid from the bottom of the grip portion 1 onto the bar assembly 9. The pin 7 is replaced to, as stated above, hold the grip shells 3 and the grip back 5 in place.

Figures 4, 5:
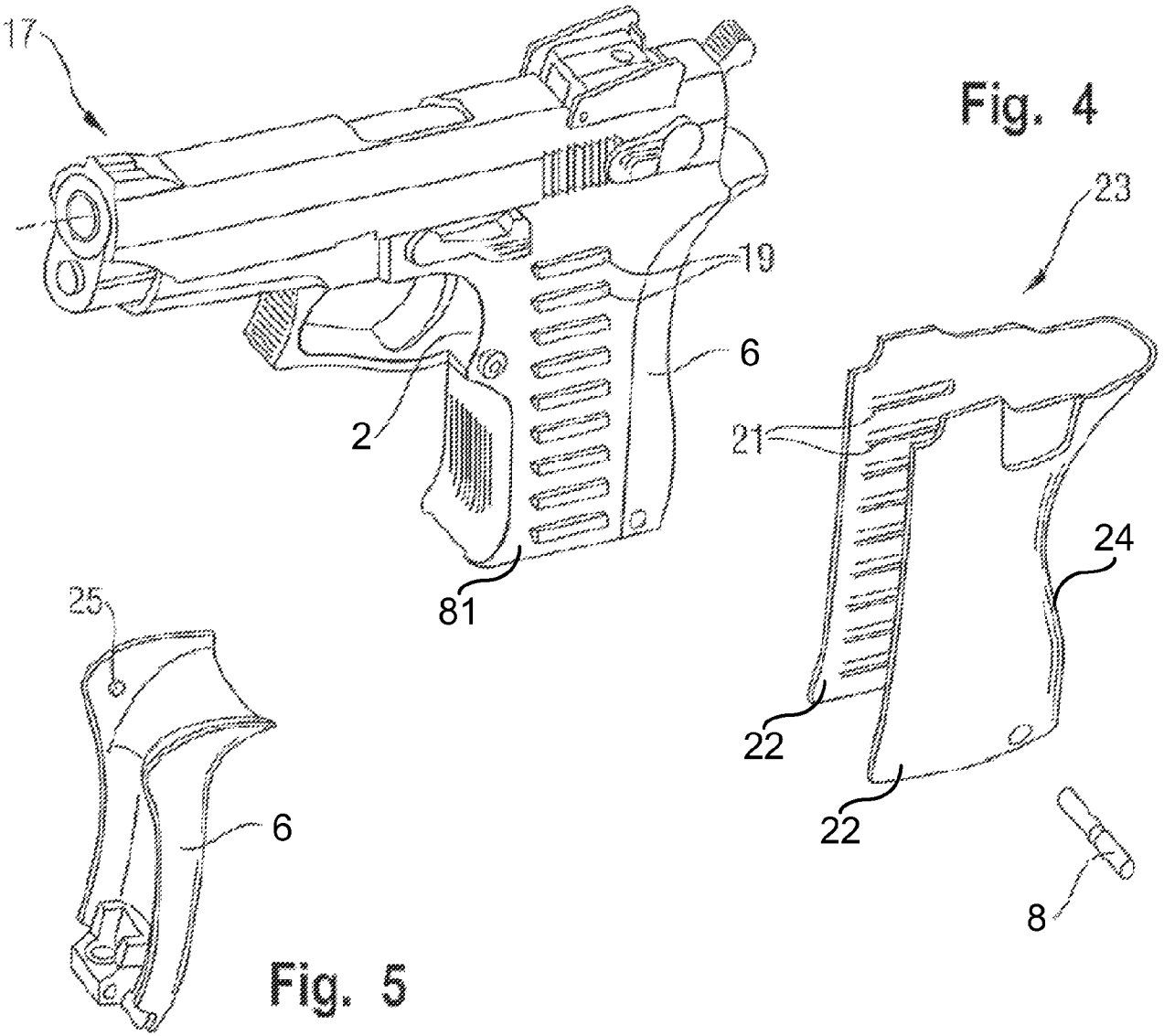
FIG. 4 illustrates an exploded view of an alternative example firearm with an alternative example grip portion including an alternative example grip back and an example grip casing.
FIG. 5 is a perspective view of the example grip back of FIG. 4.

FIG. 4 and FIG. 5 illustrate an alternative example of a grip portion 2 of an example firearm 17 that may be, for example, a self-loading handgun. The grip portion 2 may include a plurality of bars 19 that are positioned substantially parallel to each other and substantially parallel to the shooting direction. The bars 19 may be low and may include an upward projection and/or a downward projection. The plurality of bars 19 may also have a hammerhead profile. The grip portion 2 with bars 19 may form the basic structure of the firearm 17 and may form a complete firearm for people with small hands. A slim grip back 6 may be coupled to the rear side of the grip portion 2. A thin-walled grip cover or U-shaped grip casing 23 may be included that has two walls that may be placed over the grip back 6. Alternatively, the grip casing 23 may replace the grip back 6. The U-shaped grip casing 23 may correspond to the grip shells 3 and the grip back 5 described above with respect to the earlier example grip portion 1. Thus, sidewalls 22 of the grip casing act as the grip shells 3 and a backside 24 of the grip casing is the grip back 5, 6.

The grip casing 23 may also include a plurality of grooves 21 that complement the plurality of bars 19 on the grip portion 2. In the illustrated example, the grooves 21 are shown on an interior face of the side walls 22. In the illustrated example, if the firearm 17 requires a larger grip, the U-shaped grip casing 23 may be attached to the grip portion 2 or may be attached to the grip back 6 from the rear of the grip portion 2 such that the grooves 21 on the interior face of the side walls 22 of the U-shaped grip casing 23 engage the bars 19 on the grip portion 2. To secure the U-shaped grip casing 23 to the grip portion 2, an attachment or pin 8 that runs transverse through the U-shaped grip casing 23 and the grip portion 2 is set in place. Because the U-shaped grip casing 23 increases the size of the grip, the pin 8 in this example may be longer than the pin 7 used to couple the grip back 5 to the grip portion 1 of the prior example. In addition, as shown in FIG. 5, the example grip back 6 may have two clamp stops 25 on the inside upper wall that face each other. The clamp stops 25 may engage in corresponding boreholes (not shown) of the grip portion 2. The clamp stops 25, along with the pin 8, couple the grip back 6 to the grip portion 2.

The grip back 6 may be replaced with a thicker grip back 6 or may be removed and replaced with the U-shaped grip casing 23 that may have an integrated grip back. It may be possible to encase a grip back that is attached to the grip portion 2 with the grip casing 23. Alternatively, it may be possible to substitute the grip backs completely by using a grip casing 23 that has a grip back as an integral component.

In other examples, the shape and contour of the grip portion 2 may vary and, consequently, there may be an assortment of exchangeable grip casings 23 having inside contours corresponding to the outside contours of the grip portion 2. In addition, the outside contours of the grip casings 23 may differ based on the need for different styles and sizes of grip (the same is also true for the outside contours, shapes and sizes of the grip shells 3 and/or grip back 5 of the earlier example).

In another alternative example, the grip back 5, 6 may be assembled from two components, namely, a (partial) grip back 5 attached rigidly or replaceably to a "bare" grip portion 1, 2 (e.g., similar to the grip back 6 of FIG. 5) and another grip back (partial) that forms a brace of the U-shaped grip casing 23. In an assortment of replaceable grip casings 23, the individual grip casings 23 may differ with regard to shape, size and/or flexibility of their grip back 5, 6 components.

FIG. 6-FIG. 10 illustrate another example firearm 600 including another example grip portion 4 with two grip shells 10 and one grip back 12 that may be replaceably attached to the grip portion 4. As noted above with the prior example, the grip shells 10 and/or grip back 12 may be of varying thickness.

Figure 10:
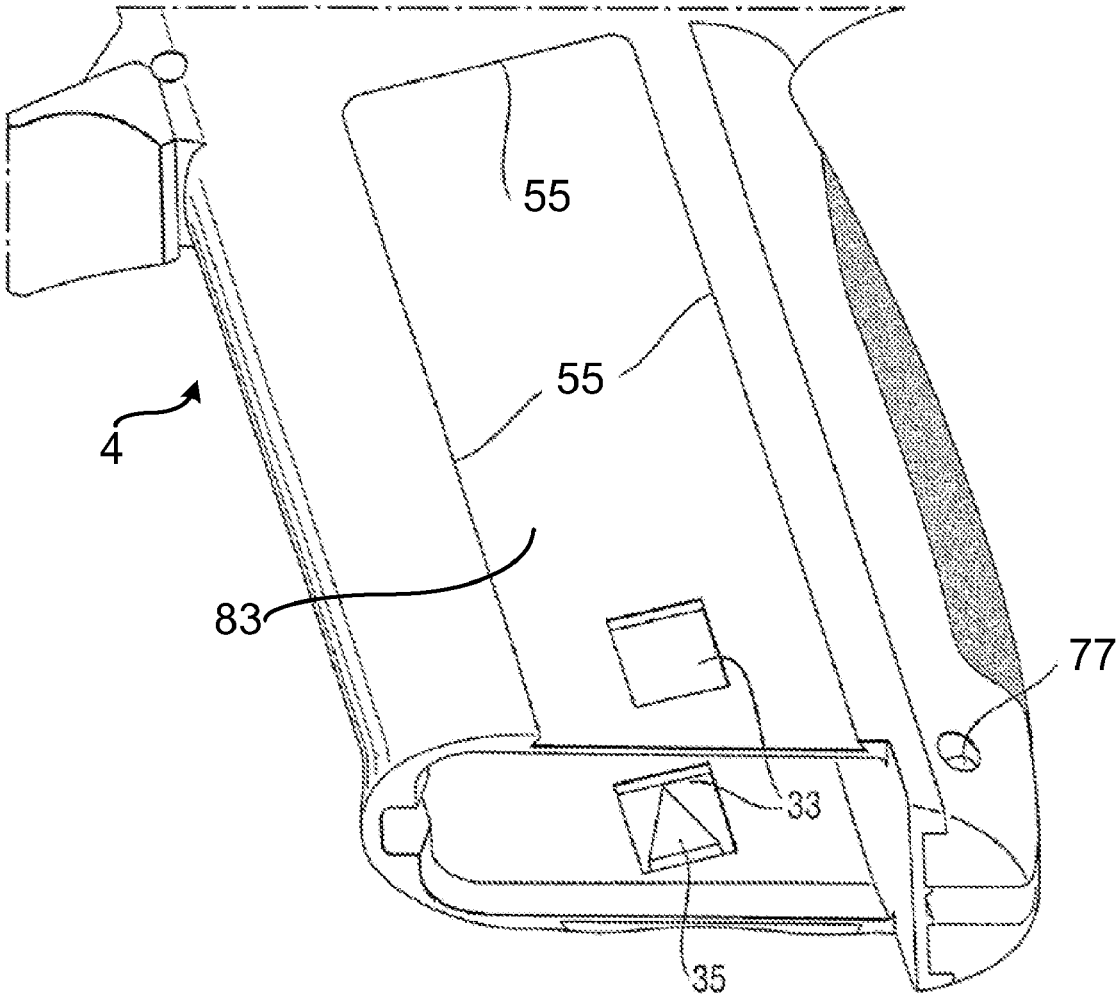
FIG. 10 shows the portion of the example grip portion of FIG. 9 with the example grip shells removed.

FIG. 10 shows that the example grip portion 4 may have three straight, connected ribs 55 that form a flat rectangle on the grip portion 4 opening to the bottom. This rectangle forms one continuous surface and provides structure to support the transmission of energy within the grip portion 4 during weapon fire. The grip shells 10 may be coupled to the grip portion 4 by sliding the desired grip shells 10 from the bottom of the grip portion 4 under the ribs 55. A continuous recess 33 may be included in the bottom area of each rectangle. The grip shells 10 may have lugs 35 (FIG. 10) positioned in the bottom area of each rectangle. The lugs 35 may engage in corresponding recesses 33 and secure the grip shells 10 once the final positions of the grip shells 10 are reached on the grip portion 4. In the final position, the bottom edge of the grip shells 10 may be flush to the bottom edge of the grip portion 4.

Figure 6:
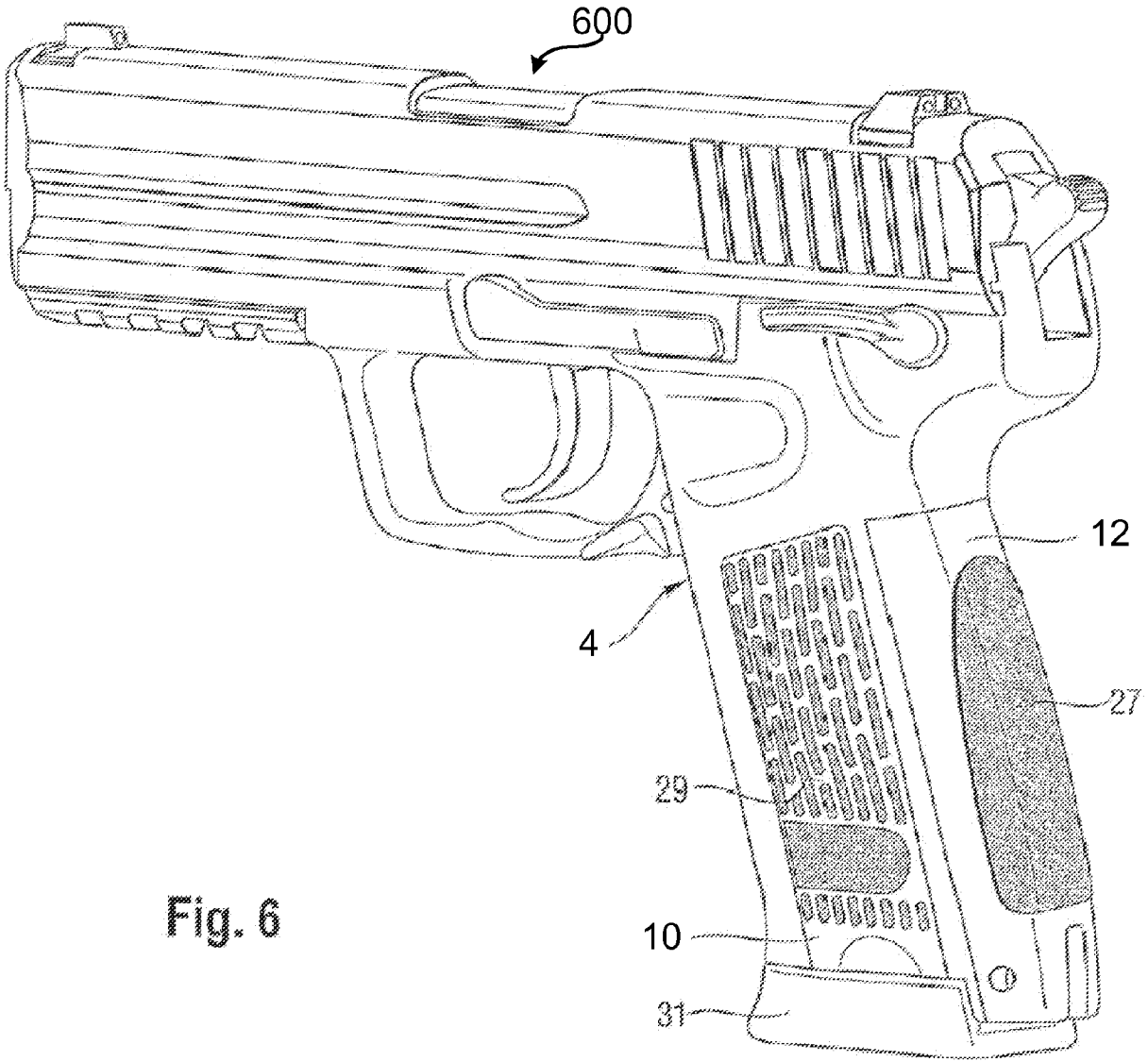
FIG. 6 illustrates another alternative example firearm with another alternative example grip portion including another alternative example of grip shells and grip back.
Figure 7:
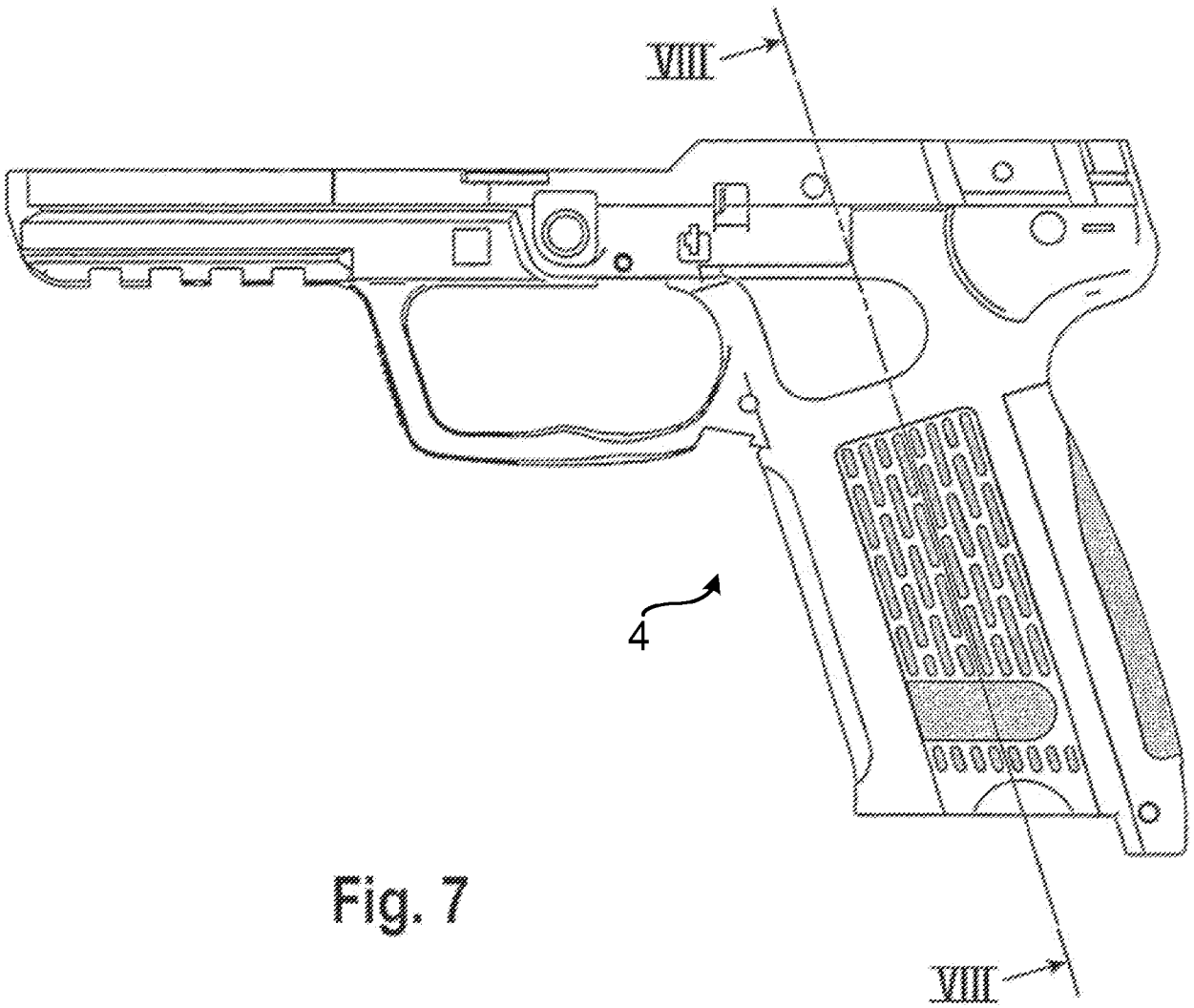
FIG. 7 is a side view of the example grip portion of the example firearm of FIG. 6.
Figure 8:
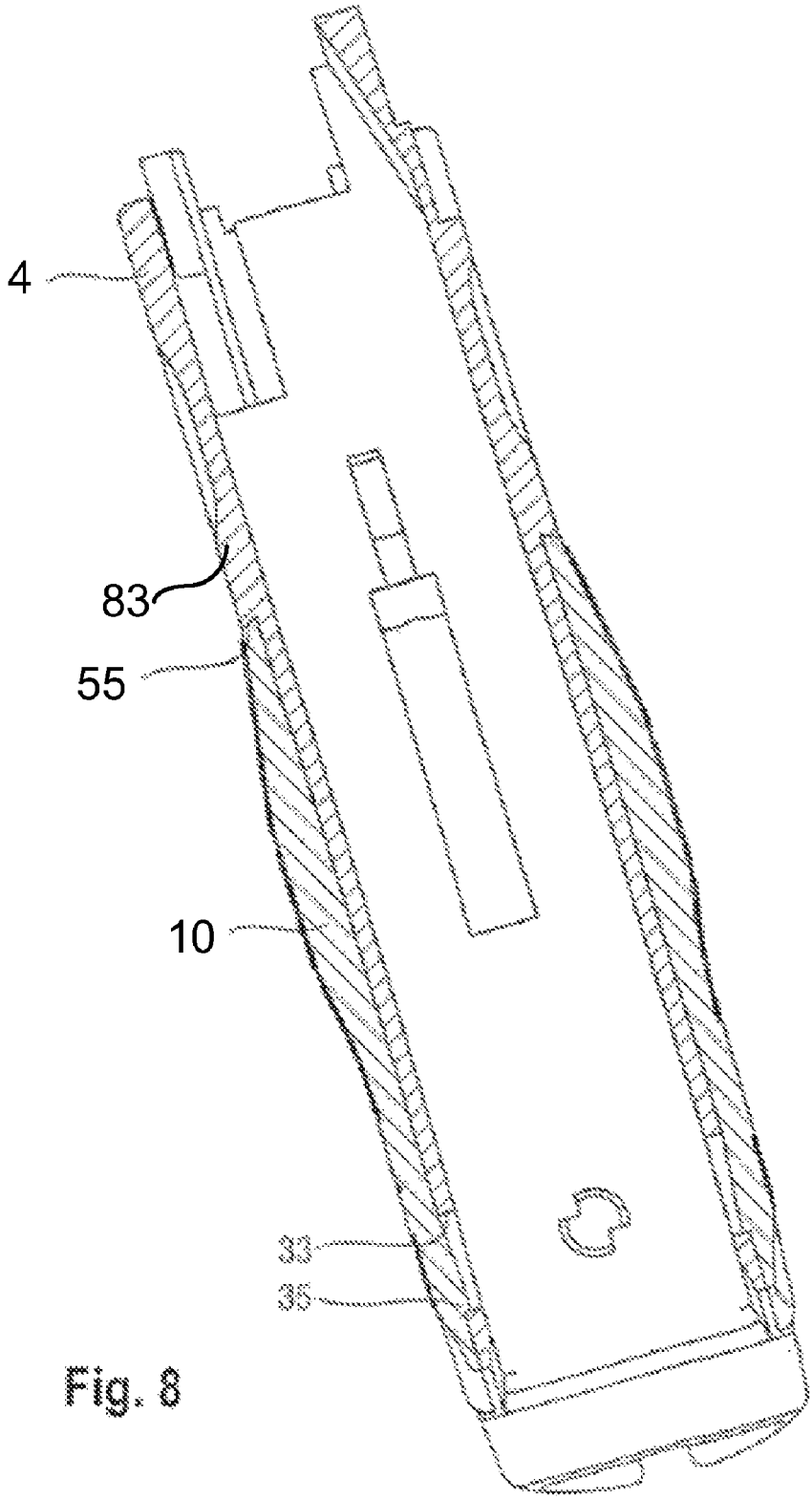
FIG. 8 is a cross-sectional view taken along the VIII-VIII line of FIG. 7.

As illustrated in FIG. 6, a preformed piece 31 may attach flush with the bottom edge formed by the grip shells 10 and the grip portion 4. The preformed piece 31 may be coupled to the magazine (not shown) and, therefore, the grip portion 4 has a continuous design.

The grip shells 10 may have supports 29 that are made of a soft or relatively softer material that may improve the fit of the hand to the grip shells 10 (FIG. 6).

If the grip shells 10 have to be removed and/or replaced with different grip shells, one may press the lug 35 from the magazine (not shown) (e.g., with the use of a suitable tool, etc.) until it is possible to slide the grip shells 10 downward.

Figure 9:
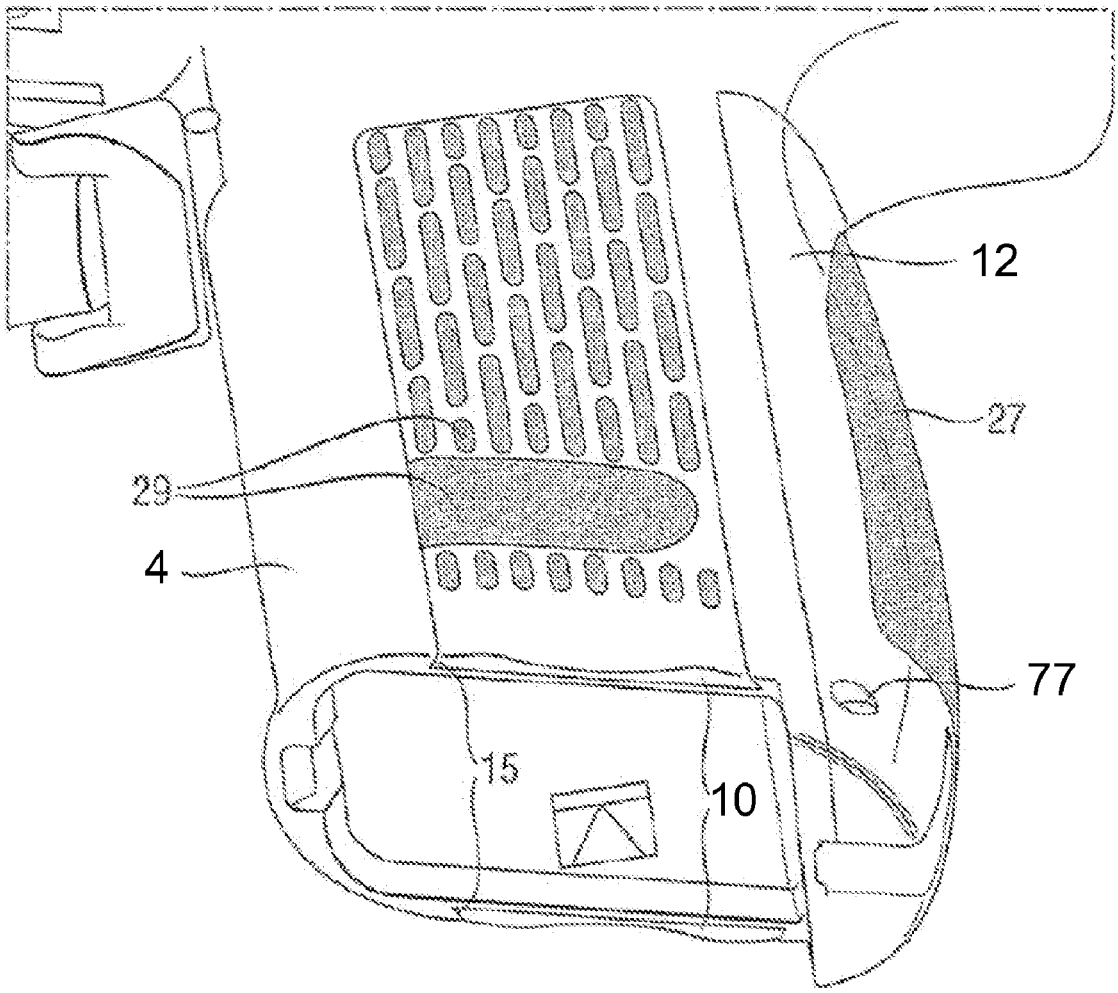
FIG. 9 is an enlarged view of a portion of the example grip portion of the example firearm of FIG. 6.

The grip back 12 may be attached to the grip portion 4 from the bottom of the grip portion 4, independent of the attachment of the grip shells 10 similar to how the prior example grip back 5 of FIG. 2 may be attached to the grip portion 1 from the bottom of the grip portion 1, independent of the attachment of the grip shells 3. In its final position on the grip portion 4, the grip back 12 may be coupled to the grip portion 4 by an attachment pin 77 (FIG. 9), in the same manner as the grip back 5 is coupled to the grip portion 1 via the pin 7 of FIG. 4. The grip back 12 may include a support surface 27 on its rear side that may consist of a soft or relatively softer material that improves the fit of the hand to the grip back 12 and the grip shells 10 (FIG. 6, FIG. 9).

It may be possible to arrange the grip shells 3, 10 and the grip back 5, 6, 12 to match different user's hands with different anatomical conditions. The grip shells 3, and the grip back 5, 6, 12 may be part of a common construction set being used together for the grip portion 1, 2, 4. The grip shells 3, 10 and/or the grip back 5, 6, 12 may be individually removed from the grip portion 1, 2, 4 and, as appropriate, replaced by a different grip shell or different grip back, resulting in a grip design fitting the anatomy of the marksman and the occasion in which the weapon is being used.

The examples illustrated and described herein may have at least one removable and replaceable grip shell 3, 10. Positioned under the removable and replaceable grip shell 3, 10 the grip portion 1, 2, 4 may have a wall 79, 81, 83 (FIGS. 3, 4, and 8 respectively) covering the magazine. Both grip shells 3, 10 may be removable and replaceable. The grip back 5, 6, 12 may be individually removable and replaceable. The wall 79, 81, 83 covering the magazine may be closed and cover the magazine completely, or may cover only a portion thereof.

The grip of any of the example firearms (e.g., the self-loading handgun 17), in which the grip portion 1, 2, 4 may consist of plastic material or well-tried plastic material, and may be easily, comfortably and better adjusted to the size and form of the hand of a marksman. This may apply to ordinance weapons which largely form a standardized line. As a result, a person with a small hand may use the firearm (e.g., the self-loading handgun 17) without the grip shells 3, 10 or grip back 5, 6, 12 or with thin grip shells 3, 10 and a slim grip back 5, 6, 12. A person with a large hand, on the other hand, may use thick grip shells 3, 10 and a thick grip back 5, 6, 12. By providing a selection of grip shells 3, 10 and grip backs 5, 6, 12 it may be possible to increase the optimum range of application of the weapon.

Cut, bare or otherwise weakened or instable grip portions 1, 2, 4 may endure a small number of shots without sustaining permanent damage. Thus, if a shot is released mistakenly or otherwise discharged while the grip shells 3, 10 were removed or if the firearm has to be used in an emergency situation, etc. a few shots may be discharged without damaging the firearm. Furthermore, the grip portions 1, 2, 4 may have the required stability to endure permanent use even without the grip shells 3, 10 design, i.e., the grip shells 3, 10 in place.

As known in the prior art, the thickness of the grip in the shooting direction may be adjusted. Furthermore, in the illustrated examples, the thickness of the grip diagonally to the shooting direction may be adjusted. In addition, the examples illustrated and described herein also allow for a specific and varied designs of the grip shells 3, 10. For example, the grip shells 3, 10 may be designed to include a thumb support for right-handed or left-handed marksmen, bulges preventing the slipping of a small hand, etc. In fact, because the grip may be designed in any number of various ways, the grip may be constructed so a finger placed alongside the grip shell 3, 10 may be bent at the same angle, regardless of the size of the marksman's hand.

As detailed above, there are several mechanisms used to engage the grip portions 1, 2, 4 with the grip shells 3, 10 and/or grip backs 5, 6, 12. For instance, the example grip shells 10 of FIGS. 6-10 may have recesses 33 that may be clasped over lugs 35 of the grip portion 4. The example grip shells 3 and/or grip back 5 of FIGS. 1-3 may be attached to the grip portion 1 with an undercut tongue and groove connection formed via one or more of the bar assembly, the complementary bars, and the ribs 15. In addition, the example grip casing 23 and/or grip back 6 of FIGS. 4-6 maybe attached to the grip portion 2 also with an undercut tongue and grove connection formed via the bars 19 and the groves 21 in the grip casing 23. Focusing on the first example (though the same may be true for the other examples), the tongue and groove connection may have a load-bearing assembly between the grip shells 3 or grip back 5 and the grip portion 1 so that the grip shell 3 may contribute to stability. Recent die-casting methods may allow for precise production of tongue and groove connections without increasing production costs, because the plastic that may be used for the grip shells 3 and/or grip back 5 may be kept within limits of flexibility, and therefore, able to adjust for minor imbalances. The tongue and groove connection on the grip portion 1 may increase the stability of the grip portion 1 such that the grip portion 1 may be used even without the grip shells 3 (e.g., if the hand of the marksman is particularly small). Here, the ribs 15, for example, form a stable surface for the grip portion 1 that supports steady grip and operation of the firearm.

As described above, the grip shells 3 and/or grip back 5 may be attached to the grip portion 1 by sliding at least one of a plurality of lateral edges of the grip shells 3 and/or grip back 5 (e.g, top edge, bottom edge, etc.) under a rib 15 of the grip portion 1. The opposite side of the grip shells 3 and/or grip back 5 may be coupled in at least one location to the grip portion 1. The grip back 5 may include a top edge and/or a bottom edge. The projecting ribs 15 may also support the stability of the grip portion 1.

In the illustrated examples, the grip shells 3 may be attached to the grip portion 1 by sliding the front edge of the grip shells 3 under a rib 15 of the grip portion 1. The grip back 5 may engage the rear edge of the grip shells 3 to secure the grip shells 3 in place. The grip back 5 may be attached to the grip portion 1 from the bottom and may slide over the rear edge of the grip shells 3. A secure fit of the grip shells 3 may be achieved when the grip back 5 is attached from below and may slide the grip shells 3 forward by pressing the grip shells 3 from the rear.

Additional ribs 15 may extend along the top and bottom edge of the grip shells 3. The grip shells 3 may be attached to the grip portion 1 by sliding the grip shells 3 under the top and/or bottom ribs 15. The grip back 5 may engage the rear edge of the grip shells 3 to secure the grip shells 3 in place. The ribs 15 and grip shells 3 may interact so that the grip back 5 is secured substantially immovably (i.e., preventing or at least reducing the grip portion 1 from shifting while shooting).

The grip back 5 also may be mounted to the grip portion 1 by a snap-in attachment. However, snap-in attachments have the disadvantage of possibly impeding or preventing the removal of the grip back 5. Therefore, the grip back 5 may be coupled to the grip portion with the transverse pin 7. The transverse pin 7 may have a circular groove with a spring element (e.g., an impact spring) engaging into it, and therefore, the transverse pin 7 may not form a tight fit when inserted through the grip portion 1 and grip back 5 (i.e., as in the case of steel grip pieces). The transverse pin 7 may be pushed out if the firearm is not drawn, and therefore, not ready to fire.

Further, as described above with respect to the example of FIGS. 4-6, the grip portion 2 also may include the bars 19 arranged on the outside of the closed wall 81 running from the front to the back. The bars 19 may have an area projecting upward (i.e., an upward projection) and/or downward (i.e., a downward projection) that engage in the complementary grooves 21 which may be recessed on inside faces of the sidewalls 22 of the grip casings 23. The bars 19 may be designed to enable and support holding the firearm 17 with the hand. The bars 19 may have the profile of a hammer head, a dovetail or the like. As mentioned above, the bars 19 may reinforce the grip portion 2, and therefore, the firearm grip may be used long-term without the grip shells 3 or the grip casing 23.

The bars 19 may run in a straight line in the slide-on direction but are curved vertically to the slide-on direction. It may be possible to slide the grip shells 3 (e.g., thin, flexible grip shells 3) or the grip casing 23 onto the slightly curved bars 19 of the grip portion 2, so that the grip shells 3 or the grip casing 23 fit snuggly to the grip portion 2. This may make it possible to use very thin grip shells 3 or a very thin grip casing 23 for marksmen with very small hands. In the alternative, the bars 19 may not have to run in a straight line.

Alternatively, the grip portion 2 may be used without grip shells 3 and may include the grip back 5 or a replacement grip back 6 that is tightly attached to the closed wall 81 or its bars 19, and therefore, the weapon or handgun 17 may be used as standard equipment for small hands if no (additional) grip shell 3 is to be used. Furthermore, the grip back 5, 6 may be adjusted for use with a small hand. If the grip is too small for a marksman, he/she may remove the grip back 5, 6 attach suitable grip shells 3 and slide on an appropriate grip back 5, 6. To prompt the selection of a suitable grip design, at least two sets of grip shells 3 and/or grip backs 5, 6 may be provided in a kit that includes the remaining portions of the firearm 17. The grip shells 3 may be equipped with a thumb support for right-handed or left-handed marksmen, which allows stores or other retail outlets to supply each individual customer with the appropriate weapon, because there is a selection of several sets of grip shells 3 and/or grip backs 5, 6 for replacement and adjustment, even though only one type of weapon is in stock.

The grip shells 3, 10 and grip backs 5, 6, 12 may be individually assembled, providing a serial weapon with a grip that may be adjusted to the individual marksman (i.e., in a similar way that past weapons were custom made).

Additionally, or alternatively, the firearm 17 may include the grip casing 23, as described above. The grip casing 23 may be produced as one integral piece by means of die-casting or via other suitable methods to produce the thin walled structure, described herein. Though integral grip shells and grip backs were known for almost 100 years as illustrated via the Mauser model 1910 handgun. However, these conventional weapons were made from wood or aluminum, had very costly construction and are no longer pursued. Furthermore, in addition to having gripping features, the grip casings may also provide support for the grip portion 23 and stability to the firearm 17 overall.

In some examples, fiber glass mats may be placed into the casting mold to increase the stability of the grip shells 3, 10. Soft grip shells 3, 10 may be used if the grip shells 3, 10 are not expected to have a supporting function and the grip shells 3, are securely attached to the grip portion 1, 2, 4. Some marksmen prefer soft grip shells 3, 10. If a secure attachment of the grip shells 3, 10 is required, the soft contact surface may be attached to an inflexible component.

The outside surfaces of the various grip shells 3, 10 and/or grip backs 5, 6, 12 may have different patterns. The right and left grip shell 3, 10 may have different surface patterns (e.g., with and without thumb support, etc.), and each individual grip shell 3, 10 may be replaced with a different one possessing the same measurements but different surface patterns. The same applies to the grip backs 5, 6, 12.

The grip shells 3, 10 may be force transducing grip shells 3, 10, and the grip shells 3, 10 may be made of fiberglass enforced plastic material. If a firearm with force transducing grip shells 3, 10 (e.g., thin grip shell 3) falls down and the grip side hits a sharp edge, the grip shell 3, 10 may not be pierced, and therefore, the wall 79, 81, 83 of the grip portion 1, 2, 4 beneath the grip shell 3 which covers the (usually delicate) magazine may not be damaged.

As mentioned above, the grip shells 3, 10 may include grip-enhancing material. This material may include rough nubs that allow for a better and more secure grip with motorcycle gloves or winter gloves, for example. This material may include or contain foamed components or a soft component applied to the grip that may be colorized or include colorization and colorization may be used as an indicator for specific grip shell 3, 10 types (e.g., specific surface conditions, etc.).

Any number or combination of the components and structures described herein may be combined as a construction set or replacement set for a firearm. The construction or replacement set is based on the grips described herein and may include at least two grip shells 3, 10 that differ from each other in dimension and/or material and/or surface conditions but are otherwise the same, or which are the same overall. This construction or replacement set may or may not include the weapon. A marksman who has been issued a service weapon may purchase a construction or replacement set and test different grip designs on his service weapon to determine whether a different grip design is more favorable to him than the one provided by his employer.

The examples described herein offer great advantages for modern marksman. In the past, it was customary for all marksmen to be issued a standardized weapon that they could practice with until they were accustomed to it; however, contemporary marksmen have considerably less time available for practical training. The example firearms, grips, and/or construction or replacements kit described herein may reduce the required training period by adapting the weapon to the individual marksmen. Moreover, the examples described herein may allow a marksman to achieve better results with a customized weapon than with a standardized weapon which he/she cannot handle very well.

Several examples have been described throughout this specification. Any features from any example may be included with, a replacement for, or otherwise combined with other features from other examples.

Furthermore, although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A firearm grip, comprising:

a plastic grip portion comprising;

a wall to cover at least a portion of a magazine; and a plurality of ribs;

a first grip shell having a plurality of first lateral edges;

a second grip shell having a plurality of second lateral edges; and a grip back having a top edge and a bottom edge, wherein at least one of the first grip shell or the second grip shell is exchangeable;

wherein the grip back is coupled to the grip portion with a tongue and groove connection;

wherein at least one of the first lateral edges or the second lateral edges, is to slidably engage under one of the plurality of ribs; the top edge or the bottom edge is coupled to the grip portion via an attachment;

wherein the grip back slidably engages at least one of the first grip shell or the second grip shell to urge the at least one of the first lateral edges or the second lateral edges into engagement with one of the plurality of ribs, the grip back to hold at least one of the first grip shell or the second grip shell in place.

2. The firearm grip as defined in claim 1, wherein the attachment is a transverse pin.

3. The firearm grip as defined in claim 1, wherein the grip back is coupled to the wall covering the magazine.

4. The firearm grip as defined in claim 1, wherein one or more of the first grip shell, the second grip shell, or the grip back have a different pattern on the outside surface.

5. The firearm grip as defined in claim 1, wherein at least one of the first grip shell or the second grip shell is made at least partially out of fiber glass reinforced plastic material.

6. The firearm grip as defined in claim 1, wherein at least one of the first grip shell or the second grip shell includes a grip-enhancing material.

7. A firearm grip construction set, comprising:

a first grip shell having a plurality of first lateral edges;

a second grip shell having a plurality of second lateral edges; and a grip back having a top edge and a bottom edge, wherein at least one of the first lateral edges or the second lateral edges is to slidably engage under one of a plurality of ribs on a wall to cover a magazine, wherein the grip back is to slidably engage at least one of the first grip shell or the second grip shell to urge the at least one of the first lateral edges or the second lateral edges into engagement with one of the plurality of ribs, the grip back is to hold at least one of the first grip shell or the second grip shell in place, wherein the grip back is to be coupled to a grip portion of a firearm with a tongue and groove connection, wherein the first grip shell and the second grip shell differ in at least one of dimension, material, or surface condition.

8. A firearm grip, comprising:

a plastic grip portion comprising;

a wall covering at least a portion of a magazine; and a plurality of ribs or bars defining one or more grooves; and a first grip shell, a second grip shell, and a grip back removeably coupled to the grip portion via an attachment and a tongue and groove connection between the grip back and the plurality of ribs or bars, the grip back slidably engaging the first grip shell and the second grip shell to urge the first grip shell and the second grip shell into the respective one or more grooves.

9. The firearm grip as defined in claim 8, wherein the attachment comprises a transverse pin.

10. The firearm grip as defined in claim 8, wherein edges of the first grip shell or the second grip shell slidably engage under one or more of the plurality of ribs.

11. The firearm grip as defined in claim 8, wherein the grip back slidably engages the first and second grip shells to substantially secure the respective grip shell relative to the grip portion.

* * * * *